US007731776B2

(12) United States Patent
Chun et al.

(10) Patent No.: US 7,731,776 B2
(45) **Date of Patent: *Jun. 8, 2010**

(54) BIMODAL AND MULTIMODAL DENSE BORIDE CERMETS WITH SUPERIOR EROSION PERFORMANCE

(75) Inventors: ChangMin Chun, Belle Mead, NJ (US); Narasimha-Rao V. Bangaru, Annandale, NJ (US); Neeraj S. Thirumalai, Phillipsburg, NJ (US); Hyun-Woo Jin, Phillipsburg, NJ (US); Jayoung Koo, Bridgewater, NJ (US); John R. Peterson, Ashburn, VA (US); Robert L. Antram, Warrenton, VA (US); Christopher J. Fowler, Springfield, VA (US); Emery B. Lendvai-Lintner, Vienna, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 340 days.

This patent is subject to a terminal disclaimer.

(21) Appl. No.: 11/293,728

(22) Filed: Dec. 2, 2005

(65) Prior Publication Data

US 2007/0128066 A1 Jun. 7, 2007

(51) Int. Cl.
*C22C 29/14* (2006.01)
*B22F 3/16* (2006.01)

(52) U.S. Cl. ..... 75/244; 419/12; 419/54; 428/545

(58) Field of Classification Search ..... None
See application file for complete search history.

(56) References Cited

U.S. PATENT DOCUMENTS 1,968,067 A 7/1934 Balke (Continued)

FOREIGN PATENT DOCUMENTS

DE 1136495 9/1955

(Continued)

OTHER PUBLICATIONS

M. Jones et al, A comparison of the abrasive wear behaviour of HVOF sprayed titanium carbide- and titanium boride-based cermet coatings, Wear, vol. 251 (2001) p. 1009-1016.*

(Continued)

*Primary Examiner*—Roy King
*Assistant Examiner*—Mark L Shevin
(74) *Attorney, Agent, or Firm*—Robert A. Migliorini

(57) ABSTRACT

Multimodal cermet compositions comprising a multimodal grit distribution of the ceramic phase and method of making are provided by the present invention. The multimodal cermet compositions include a) a ceramic phase and b) a metal binder phase, wherein the ceramic phase is a metal boride with a multimodal distribution of particles, wherein at least one metal is selected from the group consisting of Group IV, Group V, Group VI elements of the Long Form of The Periodic Table of Elements and mixtures thereof, and wherein the metal binder phase comprises at least one first element selected from the group consisting of Fe, Ni, Co, Mn and mixtures thereof, and at least second element selected from the group consisting of Cr, Al, Si and Y, and Ti. The method of making multimodal boride cermets includes the steps of mixing multimodal ceramic phase particles and metal phase particles, milling the ceramic and metal phase particles, uniaxially and optionally isostatically pressing the particles, liquid phase sintering of the compressed mixture at elevated temperatures, and finally cooling the multimodal cermet composition. Advantages disclosed by the multimodal cermets are high packing density of the ceramic phase, high fracture toughness and improved erosion resistance at high temperatures up to 1000° C. The disclosed multimodal cermets are suitable in high temperature erosion/corrosion applications in various chemical and petroleum environments.

45 Claims, 5 Drawing Sheets

U.S. PATENT DOCUMENTS 3,194,656 A 7/1965 Vordahl
3,752,655 A 8/1973 Ramqvist
3,941,903 A 3/1976 Tucker, Jr.
3,999,952 A 12/1976 Kondo et al.
4,145,213 A 3/1979 Oskarsson et al.
4,194,900 A 3/1980 Ide et al.
4,365,994 A 12/1982 Ray
4,379,852 A 4/1983 Watanabe et al.
4,397,800 A 8/1983 Suzuki et al.
4,401,724 A 8/1983 Moskowitz et al.
4,403,014 A 9/1983 Bergmann
4,419,130 A 12/1983 Slaughter
4,420,110 A 12/1983 McCullough et al.
4,426,423 A 1/1984 Intrater et al.
4,436,560 A 3/1984 Fujita et al.
4,439,236 A 3/1984 Ray
4,456,518 A 6/1984 Bommaraju
4,467,240 A 8/1984 Futamoto et al.
4,470,053 A 9/1984 Maffitt et al.
4,475,983 A 10/1984 Bader et al.
4,501,799 A 2/1985 Driessen et al.
4,505,746 A 3/1985 Nakai et al.
4,515,866 A 5/1985 Okamoto et al.
4,529,494 A 7/1985 Joo et al.
4,533,004 A 8/1985 Ecer
4,535,029 A 8/1985 Intrater et al.
4,545,968 A 10/1985 Hirano et al.
4,552,637 A 11/1985 Vire et al.
4,564,401 A 1/1986 Strichman et al.
4,564,555 A 1/1986 Hornberger
4,576,653 A 3/1986 Ray
4,595,545 A 6/1986 Sane
4,596,994 A 6/1986 Matsuda et al.
4,610,550 A 9/1986 Thomke et al.
4,610,810 A 9/1986 Hasegawa et al.
4,615,913 A 10/1986 Jones et al.
4,626,464 A 12/1986 Jachowski et al.
4,643,951 A 2/1987 Keem et al.
4,652,710 A 3/1987 Karnowsky et al.
4,670,408 A 6/1987 Petzow et al.
4,671,822 A 6/1987 Hamashima et al.
4,673,550 A 6/1987 Dallaire et al.
4,681,671 A 7/1987 Duruz
4,690,796 A 9/1987 Paliwal
4,696,764 A 9/1987 Yamazaki
4,707,384 A 11/1987 Schachner et al.
4,710,348 A 12/1987 Brupbacher et al.
4,711,660 A 12/1987 Kemp, Jr. et al.
4,717,534 A 1/1988 Morita
4,718,941 A 1/1988 Halverson et al.
4,721,878 A 1/1988 Hagiwara et al.
4,725,508 A 2/1988 Rangaswamy et al.
4,729,504 A 3/1988 Edamura
4,734,339 A 3/1988 Schachner et al.
4,744,947 A 5/1988 Nilmen et al.
4,751,048 A 6/1988 Christodoulou et al.
4,755,221 A 7/1988 Paliwal et al.
4,761,344 A 8/1988 Maki et al.
4,772,452 A 9/1988 Brupbacher et al.
4,790,873 A 12/1988 Gesing et al.
4,806,161 A 2/1989 Fabiny et al.
4,808,055 A 2/1989 Wertz et al.
4,833,041 A 5/1989 McComas
4,836,982 A 6/1989 Brupbacher et al.
4,838,936 A 6/1989 Akechi
4,843,206 A 6/1989 Azuma et al.
4,847,025 A 7/1989 White et al.
4,851,375 A 7/1989 Newkirk et al.
4,859,124 A 8/1989 Moskowitz et al.
4,873,038 A 10/1989 Rapp et al.
4,880,600 A 11/1989 Moskowitz et al.
4,885,030 A 12/1989 Moskowitz et al.
4,889,745 A 12/1989 Sata
4,915,902 A 4/1990 Brupbacher et al.
4,915,905 A 4/1990 Kampe et al.
4,915,908 A 4/1990 Nagle et al.
4,916,030 A 4/1990 Christodoulou et al.
4,917,964 A 4/1990 Moshier et al.
4,929,513 A 5/1990 Kyono et al.
4,935,055 A 6/1990 Aghajanian et al.
4,948,676 A 8/1990 Darracq et al.
4,950,327 A 8/1990 Eck et al.
4,966,626 A 10/1990 Fujiki et al.
4,970,092 A 11/1990 Gavrilov et al.
4,985,202 A 1/1991 Moshier et al.
4,995,444 A 2/1991 Jolly et al.
4,999,050 A 3/1991 Sanchez-Caldera et al.
5,004,036 A 4/1991 Becker
5,010,945 A 4/1991 Burke
5,015,534 A 5/1991 Kampe et al.
5,020,584 A 6/1991 Aghajanian et al.
5,045,512 A 9/1991 Lange et al.
5,051,382 A 9/1991 Newkirk et al.
5,059,490 A 10/1991 Brupbacher et al.
5,093,148 A 3/1992 Christodoulou et al.
5,188,678 A 2/1993 Sekhar et al.
5,217,816 A 6/1993 Brupbacher et al.
5,306,339 A 4/1994 Takeda et al.
5,336,527 A 8/1994 Takahashi et al.
5,409,518 A 4/1995 Saito et al.
5,520,879 A 5/1996 Saito et al.
5,744,254 A 4/1998 Kampe et al.
5,753,163 A 5/1998 Sekhar et al.
5,792,403 A 8/1998 Massa et al.
5,837,327 A 11/1998 Sue et al.
5,854,434 A 12/1998 Saito et al.
5,854,966 A 12/1998 Kampe et al.
5,921,330 A * 7/1999 Sue et al. ..... 175/374
5,981,081 A 11/1999 Sue
6,007,922 A 12/1999 Sue et al.
6,022,508 A 2/2000 Berns
6,099,664 A 8/2000 Davies et al.
6,193,928 B1 2/2001 Rauscher et al.
6,228,185 B1 5/2001 Davies et al.
6,290,748 B1 9/2001 Jha et al.
6,372,012 B1 4/2002 Majagi et al.
6,372,013 B1 4/2002 Trout et al.
6,399,018 B1 6/2002 German et al.
6,544,636 B1 4/2003 Fukunaga et al.
6,615,935 B2 9/2003 Fang et al.
2002/0162691 A1 11/2002 Fang et al.
2004/0231460 A1 * 11/2004 Chun et al. ..... 75/244

FOREIGN PATENT DOCUMENTS

EP 0115688 A2 8/1984
EP 0 426 608 A2 5/1991
EP 0 659 894 A2 6/1995
EP 1 077 270 A1 2/2001
GB 1 404 734 9/1975
GB 1 486 964 9/1977
GB 2 109 409 A 6/1983
JP 51 55708 5/1976
JP 55 65342 5/1980
JP 55 79801 6/1980
JP 56 8904 1/1981
JP 56 23256 5/1981
JP 56 55534 5/1981
JP 59 222556 12/1984

JP 11-209841 8/1999

OTHER PUBLICATIONS

A. Bellosi and F. Monteverde, Microstructure and Properties of Titanium Nitride and Titanium Diboride-Based Composites, Key Engineering Materials, vols. 175-176 (2000), p. 139-148.*

D.A. Weitz. Packing in the spheres. Science, vol. 303, Feb. 2004, p. 968-969.*

P.M. Chaikin et al. Some observations on the random packing of hard ellipsoids, Ind Eng. Chem. Res., vol. 45, 2006, p. 6960-6965.*

S. S. Orden'Yan et al., Temperature Dependence of the Strength of Sintered TiB2-Fe Composites, Leningrad Technological Institute, UDC 621,762, No. 7(235), pp. 94-97, Jul. 1982. Original article submitted Jan. 12, 1981 [595-597].

* cited by examiner

BIMODAL AND MULTIMODAL DENSE BORIDE CERMETS WITH SUPERIOR EROSION PERFORMANCE

FIELD OF THE INVENTION

The present invention relates to cermet materials. It more particularly relates to cermet materials comprising a metal boride. Still more particularly, the present invention relates to cermet materials comprising $TiB_2$ with a bimodal or multimodal grit distribution and the method of making the same. These cermets are particularly suitable for high temperature applications wherein materials with superior erosion resistance, fracture toughness and corrosion resistance are required.

BACKGROUND OF THE INVENTION

Erosion resistant materials find use in many applications wherein surfaces are subject to eroding forces. For example, refinery process vessel walls and internals exposed to aggressive fluids containing hard, solid particles such as catalyst particles in various chemical and petroleum environments are subject to both erosion and corrosion. The protection of these vessels and internals against erosion and corrosion induced material degradation especially at high temperatures is a technological challenge. Refractory liners are used currently for components requiring protection against the most severe erosion and corrosion such as the inside walls of internal cyclones used to separate solid particles from fluid streams, for instance, the internal cyclones in fluid catalytic cracking units (FCCU) for separating catalyst particles from the process fluid. The state-of-the-art in erosion resistant materials is chemically bonded castable alumina refractories. These castable alumina refractories are applied to the surfaces in need of protection and upon heat curing hardens and adheres to the surface via metal-anchors or metal-reinforcements. It also readily bonds to other refractory surfaces. The typical chemical composition of one commercially available refractory is 80.0% $Al_2O_3$, 7.2% $SiO_2$, 1.0% $Fe_2O_3$, 4.8% MgO/CaO, 4.5% $P_2O_5$ in wt %. The life span of the state-of-the-art refractory liners is significantly limited by excessive mechanical attrition of the liner from the high velocity solid particle impingement, mechanical cracking and spallation.

Ceramic-metal composites are called cermets. Cermets of adequate chemical stability suitably designed for high hardness and fracture toughness can provide an order of magnitude higher erosion resistance over refractory materials known in the art. Cermets generally comprise a ceramic phase and a binder phase and are commonly produced using powder metallurgy techniques where metal and ceramic powders are mixed, pressed and sintered at high temperatures to form dense compacts.

U.S. patent application Ser. No. 10/829,816 filed on Apr. 22, 2004 to Bangaru et al. discloses cermet compositions with improved erosion and corrosion resistance under high temperature conditions, and a method of making thereof. The improved cermet composition is represented by the formula (PQ)(RS) comprising: a ceramic phase (PQ) and binder phase (RS) wherein, P is at least one metal selected from the group consisting of Group IV, Group V, Group VI elements, Q is boride, R is selected from the group consisting of Fe, Ni, Co, Mn and mixtures thereof, and S comprises at least one element selected from Cr, Al, Si and Y. The ceramic phase disclosed is in the form of a monomodal grit distribution. U.S. patent application Ser. No. 10/829,816 is incorporated herein by reference in its entirety.

A need exists for cermet materials with high density, high fracture toughness and improved erosion and corrosion resistance properties for high temperature applications. The new and improved bimodal and multimodal cermet compositions of the instant invention satisfy this need. Furthermore, the present invention includes an improved method for protecting metal surfaces with bimodal or multimodal cermet compositions against erosion and corrosion under high temperature conditions.

SUMMARY OF THE INVENTION

According to the present disclosure, an advantageous multimodal cermet composition comprises: a) a ceramic phase, and b) a metal binder phase, wherein the ceramic phase is a metal boride with a multimodal distribution of particles, wherein at least one metal is selected from the group consisting of Group IV, Group V, Group VI elements of the Long Form of The Periodic Table of Elements and mixtures thereof, and wherein the metal binder phase comprises at least one first element selected from the group consisting of Fe, Ni, Co, Mn and mixtures thereof, and at least one second element selected from the group consisting of Cr, Al, Si and Y, and Ti.

A further aspect of the present disclosure relates to an advantageous bimodal cermet composition comprising: a) a $TiB_2$ phase with a bimodal distribution of particles in the size range of about 3 to 60 microns and about 61 to 800 microns; b) a $M_2B$ phase wherein M is selected from the group consisting of Cr, Fe, Ni, Ti and combinations thereof; c) an impurity phase selected from the group consisting of $TiO_2$, TiC, TiN, Ti(C,N), and combinations thereof, and d) a metal binder phase comprising at least one first element selected from the group consisting of Fe, Ni, Co, Mn and mixtures thereof, and at least one second element selected from the group consisting of Cr, Al, Si and Y, and Ti.

A further aspect of the present disclosure relates to an advantageous method for protecting a metal surface subject to erosion at temperatures up to 1000° C., the method comprising the step of providing a metal surface with a multimodal cermet composition, wherein the composition comprises: a) a ceramic phase, and b) a metal binder phase, wherein the ceramic phase is a metal boride with a multimodal distribution of particles, wherein at least one metal is selected from the group consisting of Group IV, Group V, Group VI elements of the Long Form of The Periodic Table of Elements and mixtures thereof, and wherein the metal binder phase comprises at least one first element selected from the group consisting of Fe, Ni, Co, Mn and mixtures thereof, and at least one second element selected from the group consisting of Cr, Al, Si and Y, and Ti.

Another aspect of the present disclosure relates to an advantageous method for protecting a metal surface subject to erosion at temperatures up to 1000° C. with a bimodal boride cermet composition, the method comprising the following steps: a) providing a bimodal boride cermet composition, wherein the composition comprises: i) a $TiB_2$ phase with a bimodal distribution of particles in the size range of about 3 to 60 microns and about 61 to 800 microns; ii) a $M_2B$ phase wherein M is selected from the group consisting of Cr, Fe, Ni, Ti and combinations thereof; iii) an impurity phase selected from the group consisting of $TiO_2$, TiC, TiN, Ti(C,N), and combinations thereof; and iv) a metal binder phase comprising at least one first element selected from the group consisting of Fe, Ni, Co, Mn and mixtures thereof, and at least one second element selected from the group consisting of Cr, Al, Si and Y, and Ti, wherein the Ti is from about 0.1 to about 3.0 wt % of the weight of the metal binder phase, b) mixing the ceramic phase and the metal binder phase in the presence of an organic liquid and a paraffin wax to form a flowable powder mix, c) placing the flowable powder mix into a die set, d) uniaxially pressing the die set containing the flowable powder mix to form uniaxially pressed green bodies, e) heating the uniaxially pressed green bodies through a time-temperature profile to effectuate burn out of the paraffin wax and liquid phase sintering of the uniaxially pressed green bodies to form a sintered bimodal boride cermet composition, f) cooling the sintered bimodal boride cermet composition to form a bimodal boride cermet composition tile, and g) affixing the bimodal boride cermet composition tile to the metal surface to be protected.

Numerous advantages result from the bimodal cermet compositions comprising a) a ceramic phase with a bimodal distribution of particles, and b) a metal binder phase disclosed herein, method for providing the advantageous bimodal cermet compositions, and the uses/applications therefore.

An advantage of the bimodal cermet compositions comprising a) a ceramic phase with a bimodal distribution of particles, and b) a metal binder phase is that they exhibit higher packing density than conventional cermets with a monomodal grit distribution. The advantageous packing density is not limited to bimodal grit distributions, but is also achievable with trimodal and other multimodal grit distributions.

A further advantage of the disclosed bimodal cermet compositions comprising a) a ceramic phase with a bimodal distribution of particles, and b) a metal binder phase is that they exhibit improved fracture toughness in comparison to similar cermets with a monomodal grit distribution.

Another advantage of the disclosed bimodal cermet compositions comprising a) a ceramic phase with a bimodal distribution of particles, and b) a metal binder phase is that they exhibit improved erosion resistance in comparison to similar cermets with a monomodal grit distribution.

Another advantage of the disclosed bimodal cermet compositions comprising a) a ceramic phase with a bimodal distribution of particles, and b) a metal binder phase is that they exhibit outstanding hardness.

Another advantage of the disclosed bimodal cermet compositions comprising a) a ceramic phase with a bimodal distribution of particles, and b) a metal binder phase is that they exhibit good corrosion resistance.

Another advantage of the disclosed bimodal cermet compositions comprising a) a ceramic phase with a bimodal distribution of particles, and b) a metal binder phase is that they exhibit excellent stability at high temperatures from thermal degradation in its microstructure, thus making them highly desirable and unique for long term service in high temperature process applications.

Another advantage of disclosed bimodal cermet compositions comprising a) a ceramic phase with a bimodal distribution of particles, and b) a metal binder phase is that they have application in apparatus and reactor systems that are in contact with hydrocarbon environments at any time during use, including reactors, regenerators, internal cyclones, and process piping.

Another advantage of disclosed bimodal cermet compositions comprising a) a ceramic phase with a bimodal distribution of particles, and b) a metal binder phase is that they may be used to construct the surface of apparatus or applied in the form of tiles onto the surface of apparatus exposed to aggressive erosion environments at high temperatures.

These and other advantages, features and attributes of the bimodal cermet compositions comprising a) a ceramic phase with a bimodal distribution of particles, and b) a metal binder phase of the present disclosure and their advantageous applications and/or uses will be apparent from the detailed description which follows, particularly when read in conjunction with the figures appended hereto.

BRIEF DESCRIPTION OF THE DRAWINGS

To assist those of ordinary skill in the relevant art in making and using the subject matter hereof, reference is made to the appended drawings, wherein.

DETAILED DESCRIPTION OF THE INVENTION

Figure 1:
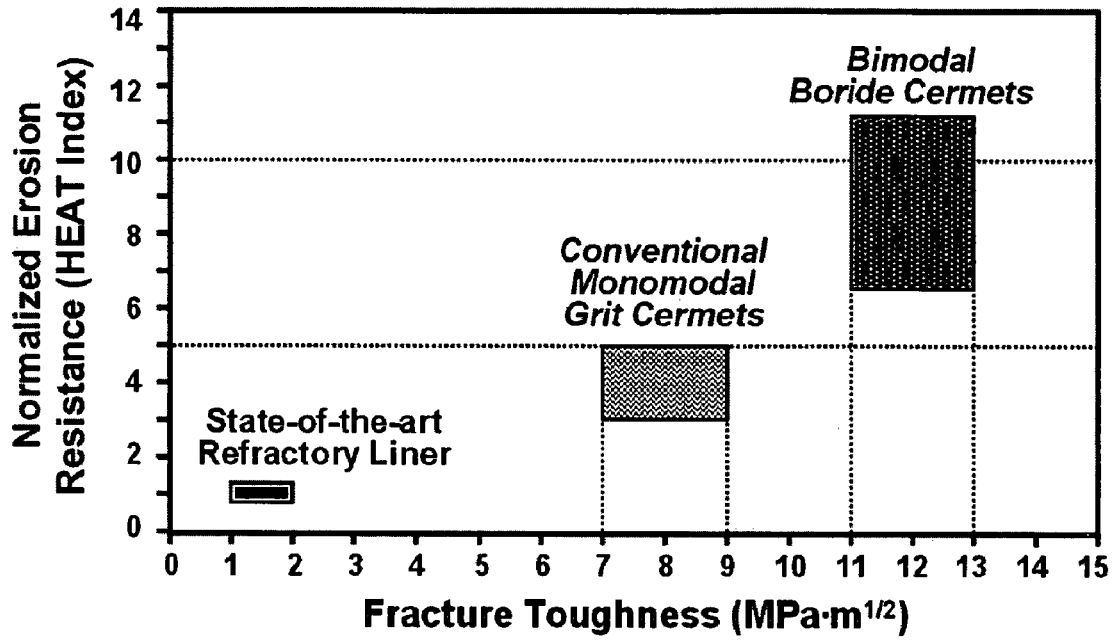
FIG. 1 depicts the improved erosion resistance and high fracture toughness of bimodal boride cermets of the present invention in comparison to conventional monomodal cermets and state-of-the-art refractory liner.

The present invention includes bimodal cermet compositions comprising a) a ceramic phase with a bimodal distribution of particles, and b) a metal binder phase. The bimodal cermet compositions of the present disclosure are distinguishable from the prior art in comprising a ceramic phase with a bimodal grit distribution suitably designed for close packing, and corresponding high density of the ceramic phase particles within the metal binder phase. The advantageous properties and/or characteristics of the bimodal cermet compositions are based in part on the closest packing of the ceramic phase particles, wherein one mode of particle distribution includes a coarse particle (grit) average size in excess of 200 microns for step-out erosion performance, including, inter alia, improved fracture toughness and erosion resistance over conventional cermets with a monomodal grit distribution.

Materials such as ceramics are primarily elastic solids and cannot deform plastically. They undergo cracking and fracture when subjected to large tensile stress such as induced by solid particle impact of erosion process when these stresses exceed the cohesive strength (fracture toughness) of the ceramic. Increased fracture toughness is indicative of higher cohesive strength. During solid particle erosion, the impact force of the solid particles cause localized cracking, known as Hertzian cracks, at the surface along planes subject to maximum tensile stress. With continuing impacts, these cracks propagate, eventually link together, and detach as small fragments from the surface. This Hertzian cracking and subsequent lateral crack growth under particle impact has been observed to be the primary erosion mechanism in ceramic materials. Of all the ceramics, titanium diboride ($TiB_2$) has exceptional fracture toughness rivaling that of diamond but with greater chemical stability (reference Gareth Thomas Symposium on Microstructure Design of Advanced Materials, 2002 TMS Fall Meeting, Columbus Ohio, entitled "Microstructure Design of Composite Materials: WC-Co Cermets and their Novel Architectures" by K. S. Ravichandran and Z. Fang, Dept of Metallurgical Eng, Univ. of Utah).

In cermets, cracking of the ceramic phase initiates the erosion damage process. For a given erodant and erosion conditions, key factors governing the material erosion rate (E) are hardness and toughness of the material as shown in the following equation $$E \propto (K_{IC})^{-4/3 \cdot Hq}$$

where $K_{IC}$ and H are respectively fracture toughness and hardness of target material, and q is experimentally determined number.

Cermets with bimodal $TiB_2$ grit distribution (bimodal boride cermets) suitably designed for closest packing can provide simultaneously high density, high fracture toughness and improved erosion resistance over conventional cermets with monomodal grit distribution. Coarse grit typically greater than the size of impinging particles provides superior erosion resistance. Fine grit that fits the gap created between coarse grit provides close packing and corresponding high packing density. The free volume space generated by bimodal grit packing provides the volume required for the metal binder phase to minimize porosity. The contiguity of metal binder phase imparts high fracture toughness. The fine grit also serves to protect the binder region from excessive, selective erosion that can take place in this region in the absence of the fine grit. Utilizing commercially available grit sizes in the range of about 3 to 60 microns and about 61 to 800 microns (bimodal approach) yields an advantageous dense packing of the grit, However, the instant invention is not limited to a bimodal grit distribution approach, but may include trimodal and other multi-modal approaches to further maximize packing density of the boride particles via the utilization of a third or more distribution of grit sizes. A trimodal approach is defined as including three different distributions of grit size. A multimodal approach is defined as including two or more different distributions of grit size.

These advantages of bimodal boride cermets are illustrated in FIG. 1, wherein normalized erosion resistance measured by Hot Erosion/Attrition Test (HEAT) is plotted against fracture toughness. By definition, normalized erosion resistance of the state-of-the-art refractory liner is 1. The fracture toughness of this castable alumina refractory is about 1~2 $MPa \cdot m^{1/2}$. Conventional monomodal grit cermets show improved erosion resistance (up to 5) and fracture toughness of 7~9 $MPa \cdot m^{1/2}$. Bimodal boride cermets of the instant invention yield further improvements in both erosion resistance (up to 10) and fracture toughness (11~13 $MPa \cdot m^{1/2}$).

One component of the bimodal cermet composition is the ceramic phase. Due to their irregular and complex shapes, these ceramic particles are not amenable to theoretical modeling of packing. Tap density measurement determines the proper ratio of coarse and fine $TiB_2$ grits for bimodal boride cermets for the highest packing density. In one non-limiting exemplary embodiment, the average particle size of the coarse $TiB_2$ grit is about 200 microns and the average particle size of the fine $TiB_2$ grit is about 15 microns. The particle size distribution of coarse grit is in the range of about 100 to about 800 microns in diameter. Particle size diameter is defined by the measure of longest axis of the 3-D shaped particle. Microscopy methods such as optical microscopy (OM) and scanning electron microscopy (SEM) may be used to determine the particle sizes. The dispersed ceramic particles can be any shape. Some non-limiting examples of the shape include spherical, ellipsoidal, polyhedral, distorted spherical, distorted ellipsoidal and distorted polyhedral shaped. The particle shape of coarse grit must be devoid of agglomerates of fine grits, termed as "raspberry" particles. The raspberry morphology of coarse grit is detrimental to achieving many advantages of bimodal cermet compositions described in this invention. A non-limiting example of a bimodal grit includes 50% coarse grit with an average particle size of 200 microns, and 50% fine grit with an average particle size of 15 microns. This bimodal mix provides a high tap density of about 3.0 g/cc and a low free volume of about 34%.

Another component of the bimodal boride cermet composition is a metal binder phase. The metal binder phase comprises at least one first element selected from the group consisting of Fe, Ni, Co, Mn and mixtures thereof, and at least one second element selected from the group consisting of Cr, Al, Si and Y, and Ti. In one exemplary embodiment, Ti is in the range of from about 0.1 to about 3.0 wt % based on the weight of the metal binder phase. The Cr and Al metals provide for enhanced corrosion and erosion resistance in the temperature range of 25° C. to 850° C. The elements selected from the group consisting of Y, Si and Ti provide for enhanced corrosion resistance in combination with the Cr and/or Al. Strong oxide forming elements such as Y, Al, Si, Ti and Cr tend to pick up residual oxygen from powder metallurgy processing and to form oxide particles within the cermet. In one non-limiting exemplary embodiment, the chromium content in the metal binder phase is at least 12 wt % based on the total weight of the metal binder phase. It is preferable to use a metal binder that provides enhanced long-term microstructural stability to the cermet. One non-limiting example of such a binder is a stainless steel composition including from about 0.1 to about 3.0 wt % Ti, which is especially suited for bimodal $TiB_2$ cermets. The preferred metal binder content is in the range of about 5 to about 40 vol % based on the volume of the cermet. More preferably, the metal binder content is in the range of about 20 to about 40 vol %.

The bimodal $TiB_2$ cermet composition may further comprise secondary metal borides, wherein the metal is selected from the group consisting of Group IV, Group V, Group VI elements of the Long Form of The Periodic Table of Elements, Fe, Ni, Co, Mn, Cr, Al, Y and Si. The secondary metal borides are primarily derived from the metal elements from a boride ceramic phase and a metal binder phase after a liquid phase sintering process at elevated temperatures. The secondary metal borides are formed by dissolution of a boride phase into a liquid metal binder phase during liquid phase sintering and reprecipitation with other metal constituents during subsequent cooing. As a non-limiting example, the bimodal boride cermet composition may include a secondary boride $M_xB_y$, where in the molar ratio of x:y can vary in the range of about 3:1 to about 1:6. For example, the bimodal $TiB_2$ cermet composition processed with Ti-containing stainless steel binder comprises a secondary boride phase, $M_2B$, wherein M comprises Cr, Fe, Ni and Ti with other minor elements derived from the binder phase composition. The total ceramic phase volume in the cermet of the instant invention includes both $TiB_2$ and the secondary borides, $M_2B$. In the bimodal $TiB_2$ cermet composition, the combined $TiB_2$ and $M_2B$ content ranges from about 60 to about 95 vol % based on the volume of the cermet, and more preferably from about 60 to about 80 vol % based on the volume of the cermet. It has been found that the amount of $M_2B$ should be kept to a minimum, preferably less than 10 vol % and more preferably, less than about 5 vol %, for superior erosion resistance and fracture toughness.

Another component of the bimodal boride cermet composition is an impurity phase. The impurity phase may include metal oxides selected from the group of metals consisting of Fe, Ni, Co, Mn, Al, Cr, Y, Si, Ti, Zr, Hf, V, Nb, Ta, Mo and W and mixtures thereof. The oxides are derived from the metal elements from elements of the boride ceramic phase and a metal binder phase. The impurity phase of the bimodal cermet composition may further include carbide, nitride, carbonitride phases and combinations thereof of a metal selected from the group consisting of Fe, Ni, Co, Mn, Al, Cr, Y, Si, Ti, Zr, Hf, V, Nb, Ta, Mo and W and mixtures thereof. The carbide, nitride, carbonitride phases and combinations thereof are derived from the metal elements of the boride ceramic phase and the metal binder phase. As a non-limiting example, the bimodal $TiB_2$ cermet composition may comprise TiC, TiN and Ti(C,N) phases known to one of ordinary skill in the art. Other impurity compounds may also be introduced from the commercial synthesis process. For example, the residual wax after binder burnout process and the carburizing and/or nitriding environments during liquid phase sintering process are responsible for imparting the presence of impurity phases. The bimodal boride cermet of the instant invention includes preferably less than about 5 vol %, more preferably less than about 2 vol %, of such impurity phases including both oxide, carbide, nitride, carbonitride phases and a combination thereof.

Another component of the bimodal boride cermet composition is an embrittling intermetallic precipitates such as a sigma phase known to one of ordinary skill in the art. The bimodal boride cermet composition of the instant invention is responsible for imparting this attribute of avoidance of embrittling intermetallic precipitates. The bimodal boride cermet of the instant invention has preferably less than about 20 vol % and more preferably less than about 5 vol % of such embrittling phases.

The volume percent of cermet phase (and cermet components) of the present disclosure excludes pore volume due to porosity. The disclosed bimodal boride cermets are characterized by porosity up to about 15 vol %. Preferably, the volume of porosity is less than about 10% of the volume of the cermet. The pores constituting the porosity are preferably not connected, but distributed in the cermet body as discrete pores. The mean pore size is preferably equal to or less than the mean particle size of the ceramic phase.

The bimodal boride cermets of the present invention utilize suitable bimodal $TiB_2$ grits and a metal binder powder in the required volume ratio. Table 1 depicts exemplary coarse and fine $TiB_2$ grits and a metal binder used for producing bimodal boride cermets having a high packing density, improved fracture toughness, and enhanced erosion performance.

TABLE 1

| Company | Grade | Chemistry (wt %) | Size |
|---|---|---|---|
| H. C. Starck | S (fine grit) | Ti: Balance, B: 31.2%, C: 0.4%, O: 0.1%, N: 0.01%, Fe: 0.06% (Development product, Similar to Lot 50356) | $D_{10}$ = 7.68 μm, $D_{50}$ = 16.32 μm, $D_{90}$ = 26.03 μm |
| H. C. Starck | S2ELG (coarse grit) | Ti: Balance, B: 31.2%, C: 0.9%, O: 0.04%, N: 0.02%, Fe: 0.09% (Development product: Similar to Lot 50216) | +106-800 μm |
| Sandvik-Osprey | 304SS + 0.25Ti | Balance Fe: 19.3Cr: 9.7Ni: 0.25Ti: 1.7Mn: 0.82Si: 0.017C | 85% −22 μm |

Figure 2:
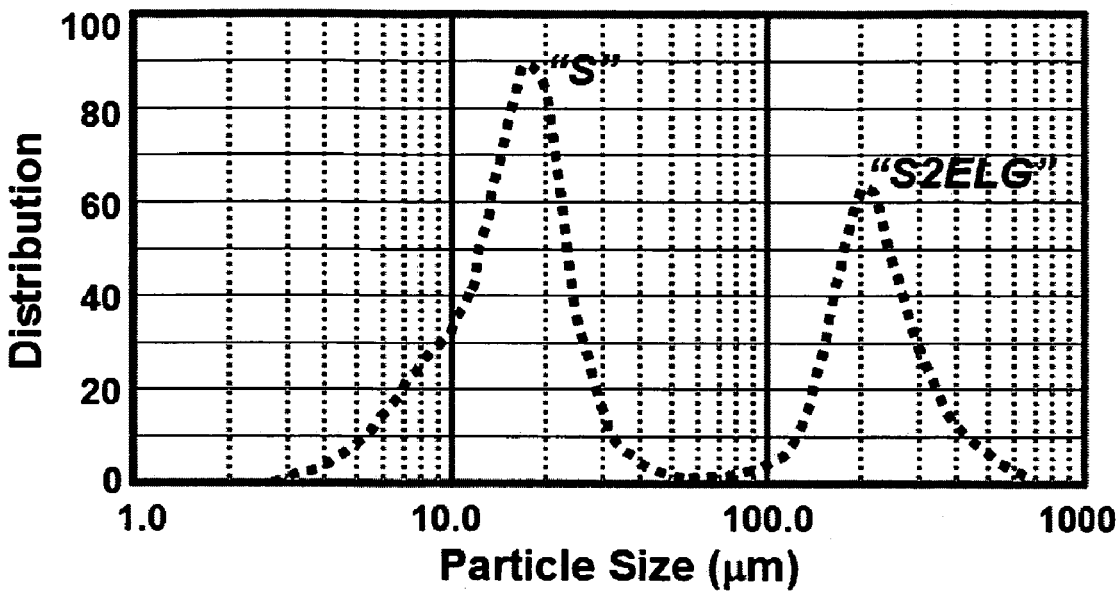
FIG. 2 depicts a particle size distribution plot for bimodal titanium diboride grit used herein.

FIG. 2 is a particle size distribution plot of the bimodal $TiB_2$ grits shown in Table 1. Laser diffraction analysis using a unified scatter technique (microtrac×100) was used to generate the bimodal grit distribution. The bimodal $TiB_2$ grit distribution depicts that the average particle size of the coarse $TiB_2$ grit is about 200 microns and the average particle size of the fine $TiB_2$ grit is about 15 microns.

The particle size distribution of the coarse $TiB_2$ grit can be further determined by a sieve classification method. The coarse $TiB_2$ grit is sized to obtain close packing. In this case mesh size is used as a measurement of particle size. It is obtained by sieving various sized particles through a screen (mesh). A mesh number indicates the number of openings in a screen per square inch. In other words, a mesh size of 100 would use a screen that has 10 wires per linear inch in both a horizontal and vertical orientation yielding 100 openings per square inch. A "+" before the mesh size indicates that particles are retained on and are larger than the sieve. A "−" before the mesh size indicates the particles pass through and are smaller than the sieve. For example, −45 mesh indicates the particles pass through and are smaller than the openings of a 45 mesh (355 μm) sieve. Typically 90% or more of the particles will fall within the specified mesh. Often times, mesh size is expressed by two numbers (i.e., +60/−45). This translates to a range in particle sizes that will fit between two screens. The top screen will have 45 openings per square inch and the bottom screen will have 60 openings per square inch. For example, one could narrow down the range of particle sizes in a batch of packing material to contain particles from 250 μm to 355 μm. First, sieve it through a screen with a mesh size of 45 (45 openings per square inch) which particles smaller than 355 μm will pass through. Then, use a second screen with a mesh size of 60 (60 openings per square inch), after the first mesh, and particles smaller than 250 μm will pass through. Between the two screens would be retained a range of particles from 250 μm to 355 μm. This batch of ceramic could then be expressed as having a mesh size of +60/−45. Table 2 shows a particle size distribution of coarse $TiB_2$ grit (H. C. Starck's S2ELG Grade) used for producing closely packed $TiB_2$ cermet of the instant invention.

TABLE 2

| $TiB_2$ Mesh Size | Approximate Micron Size (μm) | Volume Fraction (%) |
|---|---|---|
| +45 | +355 | 17.3 |
| +60/−45 | +250/−355 | 23.4 |
| +140/−60 | +106/−250 | 58.7 |
| +200/−140 | +75/−106 | 0.3 |
| +200 | −75 | 0.3 |
| Total | | 100 |

Tap density measurement based on ASTM B527 determines the proper ratio of both coarse and fine $TiB_2$ grits for bimodal boride cermets. In one non-limiting exemplary embodiment, a $TiB_2$ mixture of both coarse and fine grits at the ratio of 50 vol % coarse (H. C. Starck's S2ELG Grade) and 50 vol % fine (H.C. Starck's S Grade) provides the highest tap density (2.99 g/cc) and the lowest free volume (33.4%). The required volume percent of a metal binder powder to produce bimodal boride cermets is determined by the lowest free volume.

A method for producing bimodal cermet compositions comprising a) a ceramic phase with a bimodal distribution of particles, and b) a metal binder phase is also disclosed by the present invention. The bimodal cermets are produced by powder metallurgical techniques including, but not limited to, the steps of mixing, milling, pressing, sintering and cooling.

Bimodal ceramic grits of suitable size and metal binder powder are mixed in a ball mill with an organic liquid for a time sufficient to adequately disperse the powders. A non-limiting exemplary milling time is about 4 hours. Paraffin wax may also be added to a ball mill to provide green strength of the compact after the subsequent pressing process. An exemplary range of paraffin wax is from about 2 to about 4 wt % of the combined weight of both ceramic grit and the metal binder powder. After the milling process, the liquid is removed and the milled powder is dried. The amount of milling media in ball milling process is preferably less than about 40% of the total powder added. A non-limiting example of a suitable milling media is yttria stabilized zirconia (YSZ) balls. If the amount of milling media is in excess of the above range, the milling step may introduce subcritical microcracks in the $TiB_2$ grits, which may further lead to chipping of coarse $TiB_2$ grits during use in high temperature erosion environments, and a corresponding degradation of erosion resistance.

In order to make a flowable powder mix, other mixing methods may be utilized. A non-limiting list of alternative-mixing methods includes V-blending, spray drying, pucking and screening, Littleford mixing, Patterson-Kelley mixing, jar rolling and disc pelletizing. These alternative mixing methods provide a homogeneous distribution of the powder mix and make the powder mix flowable during the pressing process.

After the mixing and milling steps, the powder mix is placed in a die set and uniaxially pressed into a green body. In one non-limiting exemplary embodiment, the green body is in the shape of a tile of dimensions of 2.215×2.215×1.150 inches. The pressing tonnage is preferably in the range of about 10 to about 100 tons, more preferably in the range of about 40 to about 80 tons. The higher tonnage tends to create residual stress at the stress concentrating points and leads to higher cracking susceptibility in the green body due to spring back effect.

In order to heal any cracks that result from the uniaxially pressing for the production of green bodies, cold isostatic pressing (hereinafter "CIP") may be applied. The preferred pressure of the CIP step is about 30 kpsi. The green bodies are placed in a rubber bag, positioned in a hydraulic medium and subjected to an applied pressure isostatically. No cracking occurs within the green bodies processed by additional CIP process.

The resulting green bodies of the present invention formed by mixing, uniaxial pressing, and optionally cold isostatic pressing are then subjected to a sintering step by loading them into a furnace. As a non-limiting example of a sintering step, the green bodies are placed on alumina plates sprinkled with alumina sand (about 20 grit size) and loaded into a box made out of graphite. The graphite boxes are loaded into the furnace. The green bodies are ramped up to about 400° C. at about 3° C./min and held at about 400° C. for 100 minutes before being ramped up to 600° C. at 3° C./min and held for 90 minutes. This process runs in cyclic argon and vacuum environments and burns out paraffin wax binders. The binder burnt out bodies are further ramped up to 1515° C. at 5° C./min and held for 180 minutes in an argon environment at this temperature. The liquid phase sintering temperature can be above about 1200° C. and up to about 1750° C. for times ranging from about 10 minutes to about 4 hours. The sintering operation is preferably performed in an inert atmosphere or a reducing atmosphere or under vacuum. For example, the inert atmosphere can be argon and the reducing atmosphere can be hydrogen. In one exemplary embodiment, the sintered bimodal cermet composition tile prepared according to the aforementioned process of the present invention is about 2.×2×1 inches. The bimodal cermet sintered tiles can be further machined to meet the final size requirement.

Figure 3:
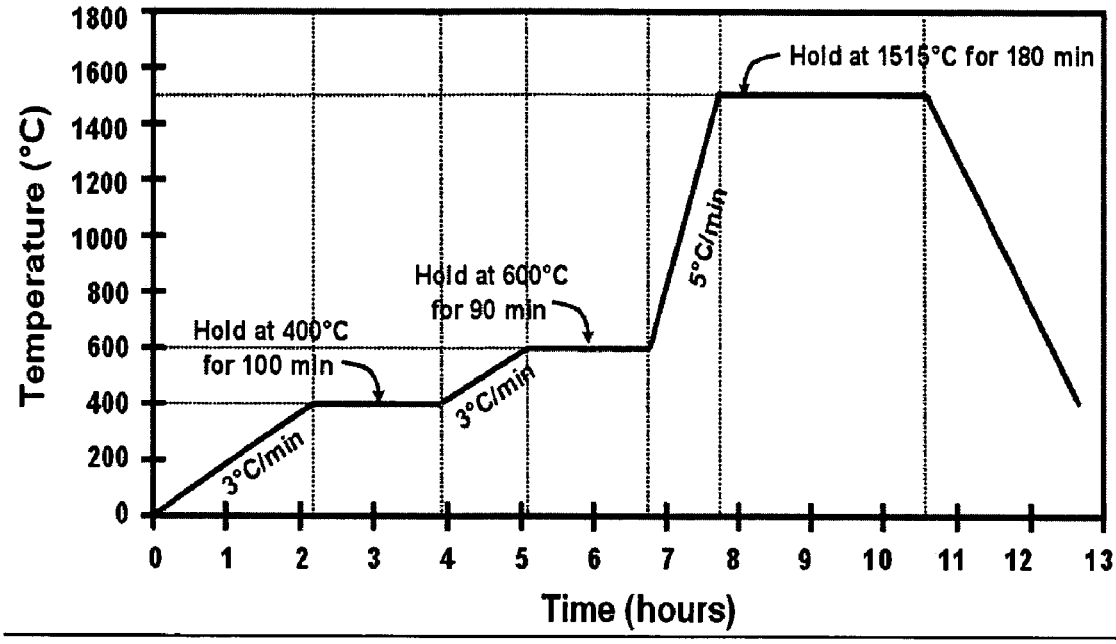
FIG. 3 depicts an exemplary heating and cooling profile plot for the production of bimodal boride cermet compositions used herein.

After sintering, the bimodal cermet composition is subjected to a cooling step. As a non-limiting example of a cooling step, the temperature is reduced to below 100° C. at about a cooling rate of −5° C./min. FIG. 3 depicts an exemplary heating and cooling profile used for the production of bimodal boride cermets. The resulting cermets of the disclosed method comprise both coarse and fine $TiB_2$ phases, a $M_2B$ phase, a Ti(C,N) phase, and a metal binder phase.

Uses of Bimodal Cermet Compositions and Methods of Application

The bimodal cermet compositions of the present disclosure are particularly suitable in high temperature erosion/corrosion applications where refractories are currently employed. For example, refinery process vessel walls and internals that are exposed to streams of aggressive catalyst particles in various chemical and petroleum environments are particularly suitable for bimodal cermet compositions. A non-limiting list of suitable uses include liners for process vessels, transfer lines and process piping, heat exchangers, cyclones, for example, fluid-solids separation cyclones as in the cyclone of Fluid Catalytic Cracking Unit used in refining industry, grid hole inserts, thermo wells, valve bodies, slide valve gates and guides, and the like. Thus, metal surfaces exposed to erosive or corrosive environments, especially at about 300° C. to about 850° C., are protected by providing the surface with a layer of the disclosed bimodal cermet compositions.

The disclosed bimodal cermet compositions can be formed into tiles. The tiles can then be affixed to inner metal surfaces of refinery and chemical process equipment by mechanical means or by welding to improve erosion and corrosion resistance at elevated temperatures.

Applicants have attempted to disclose all embodiments and applications of the disclosed subject matter that could be reasonably foreseen. However, there may be unforeseeable, insubstantial modifications that remain as equivalents. While the present invention has been described in conjunction with specific, exemplary embodiments thereof, it is evident that many alterations, modifications, and variations will be apparent to those skilled in the art in light of the foregoing description without departing from the spirit or scope of the present disclosure. Accordingly, the present disclosure is intended to embrace all such alterations, modifications, and variations of the above detailed description.

The following example illustrates the present invention and the advantages thereto without limiting the scope thereof.

EXAMPLES

Illustrative Example 1

Bimodal $TiB_2$ Cermet Composition with H. C. Starck's TiB2 Grit and Stainless Steel Metal Binder As a non-limiting example, 33 vol % coarse $TiB_2$ grit (S2ELG), 33 vol % of fine $TiB_2$ grit (S), and 34 vol % Ti-modified 304 stainless steel (304SS+0.25Ti) were mixed in a ball mill in the presence of heptane for a time sufficient to substantially disperse the powders in each other. The $TiB_2$ powder has a bimodal distribution of particles in the size range 3 to 60 microns and 61 to 800 microns. The mixture of powders was milled in a ball mill for about 4 hours. Paraffin wax was also added to the ball mill to provide green strength to the compact after the pressing step. The amount of paraffin wax added was about 2 to 4 wt % of the combined weight of both $TiB_2$ grit and stainless steel binder. After milling process, the liquid was removed and the milled powder was dried. The amount of milling media in the ball milling process was less than 40% of the powder added. Yttria stabilized zirconia (YSZ) balls was the milling media utilized. About 325 grams of powder mix was then placed in a die set, and uniaxially pressed into a green body. The green body was formed into the shape of a tile with dimensions of about 2.215×2.215×1.150 inches. The pressing tonnage was in the range of 40 to 80 tons. In order to heal the cracks that were present in the uniaxially pressed green bodies, cold isostatic pressing (CIP) was applied at a pressure of about 30 kpsi. The green bodies were then placed in a rubber bag, located in a hydraulic medium, and subjected to pressure isostatically.

The resulting green bodies that were formed by uniaxial pressing and subsequent cold isostatic pressing (CIP) were then loaded into the furnace for sintering by placing the green bodies on alumina plates sprinkled with alumina sand (about 20 grit size) and loaded into a graphite box. Within the furnace, the green bodies were ramped up to 400° C. at heating rate of 3° C./min and held for 100 minutes, and then ramped up to 600° C. at heating rate of 3° C./min and held for 90 minutes. The process was run in cyclic argon and vacuum environments to burn out the paraffin wax binder. The binder burnt out bodies were further ramped up to 1515° C. at a heating rate of 5° C./min, and then held for 180 minutes in an argon environment. The temperature was then reduced to below 100° C. at a cooling rate of −5° C./min. The sintered cermet tile prepared according to the process of the invention was about 2×2×1 inches.

Figure 4:
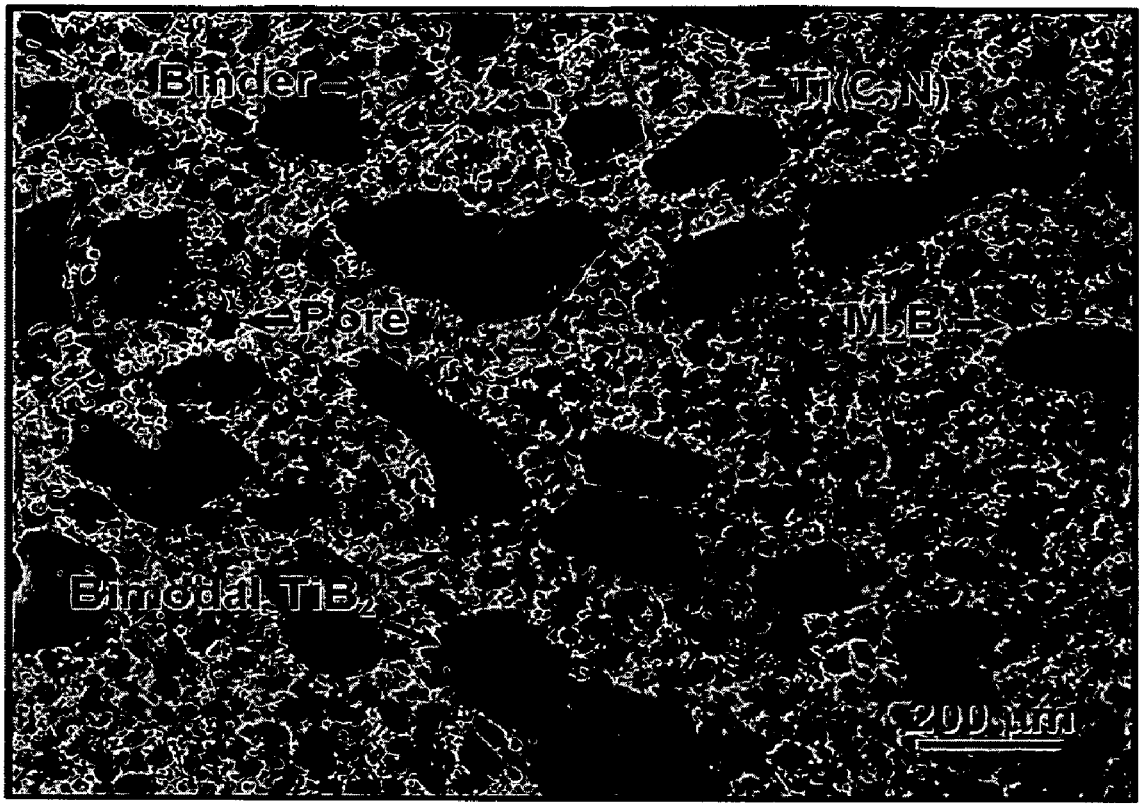
FIG. 4 depicts an optical microscopy image of a representative area of the bimodal boride cermet of the present invention illustrating a typical microstructure.
Figure 5:
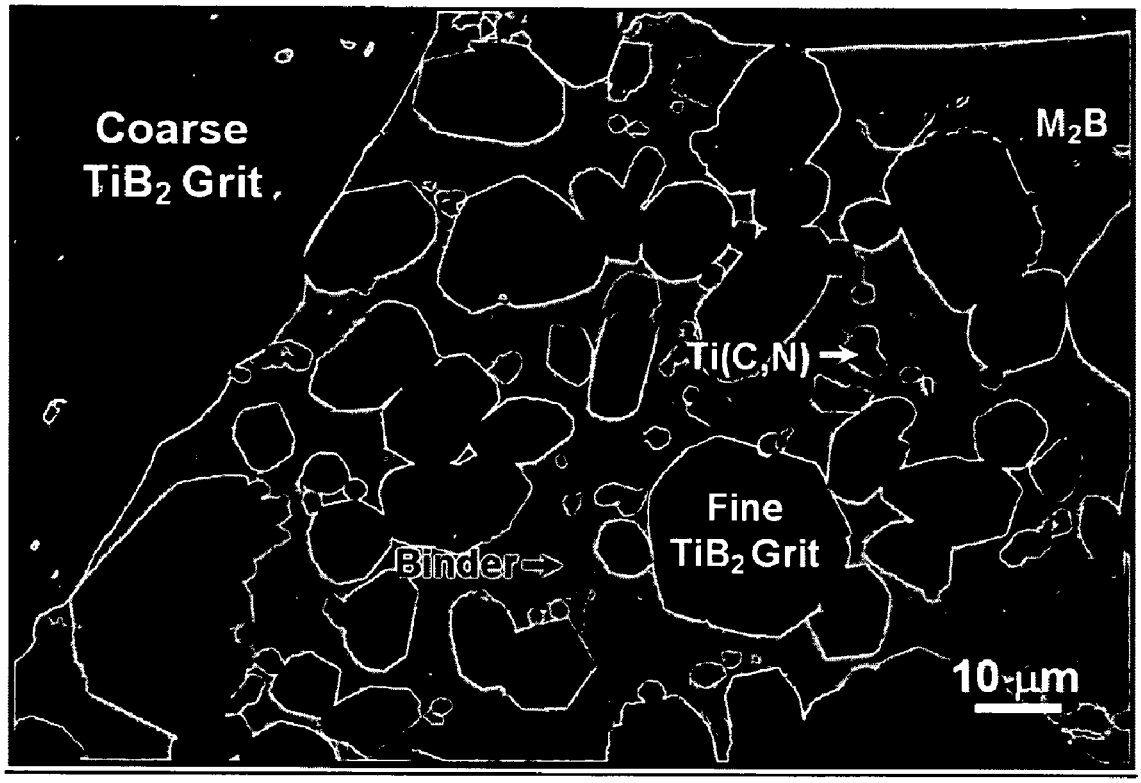
FIG. 5 depicts a representative scanning electron microscopy (SEM) image of the bimodal boride cermet depicted in FIG. 4.

FIG. 4 is an optical microscopy image of a selected area of the bimodal $TiB_2$ cermet produced according to this example, wherein the scale bar represents 200 μm. Excluding pores the resulting bimodal $TiB_2$ cermet comprises both coarse and fine $TiB_2$ phases, a $M_2B$ phase, a Ti(C,N) phase, and a metal binder phase. FIG. 5 is a SEM image of the same cermet shown in FIG. 4, wherein the bar represents 10 μm. In this image both a portion of coarse $TiB_2$ grit and fine $TiB_2$ grits appear dark and the metal binder phase appears light. The Cr-rich $M_2B$ type secondary boride phase and Ti(C,N) phase are also shown in the binder phase. By M-rich, for example Cr-rich, is meant the metal M is of a higher proportion than the other constituent metals comprising M.

Illustrative Example 2

Bimodal $TiB_2$ Cermet Composition with Sintec-Keramik's $TiB_2$ Grit and Stainless Steel Metal Binder Table 3 depicts exemplary coarse and fine $TiB_2$ grits and a metal binder used for producing bimodal boride cermets having a high packing density. The bimodal premix powder supplied from Sintec-Keramik (Development product, Lot PWT2S1-1963) is further screened to separate both fine and coarse grits.

TABLE 3

| Company | Grade | Chemistry (wt %) | Size |
|---|---|---|---|
| Sintec-Keramik | Fine | Ti: Balance, B: 30.2%, C: 0.02%, O: 0.2%, N: 0.2%, Ca: 0.05% (Sieved from the Lot PWT2S1-1963) | −53 μm (below 270 mesh) |
| Sintec-Keramik | Coarse | Ti: Balance, B: 30.2%, C: 0.02%, O: 0.2%, N: 0.2%, Ca: 0.05% (Sieved from the Lot PWT2S1-1963) | +106-800 μm (above 140 mesh) |
| Carpenter Powder Products | 321SS | Balance Fe: 18.0Cr: 10.0Ni: 1.2Ti: 1.4Mn: 0.2Si | 85% −31 μm |

Table 4 depicts the particle size distribution of Sintec-Keramik's coarse $TiB_2$ grit used for producing closely packed $TiB_2$ cermet of the instant invention.

TABLE 4

| $TiB_2$ Mesh Size | Approximate Micron Size (μm) | Volume Fraction (%) |
|---|---|---|
| +45 | +355 | 36.9 |
| +60/−45 | +250/−355 | 49.2 |
| +140/−60 | +106/−250 | 13.9 |
| Total | | 100 |

Tap density and free volume were measured for various $TiB_2$ grit mixtures to determine the proper ratio of coarse and fine $TiB_2$ grits for bimodal boride cermets. The coarse grits used were particles screened above 140 mesh (106 μm) from the original bimodal premix lot PWT2S1-1963. The fine grits used were particles screened below 270 mesh (53 μm) from the original bimodal premix lot PWT2S1-1963. Table 5 depicts the results of tap density measurement through the use of Sintec-Keramik's $TiB_2$ grits.

TABLE 5

| Volume % of $TiB_2$ Grits, Coarse:Fine | Tap Density (g/cc) | Free Volume (%) |
|---|---|---|
| 50:50 | 2.60 | 38.5 |
| 55:45 | 2.72 | 36.8 |
| 60:40 | 3.14 | 31.8 |
| 65:35 | 2.92 | 34.3 |

As a non-limiting example, a bimodal boride cermet having a high packing density is based on following formulation:

i) about 68 vol % of Sintec-Keramik's $TiB_2$ mixture having both coarse and fine grits at the ratio of 60 vol % coarse and 40 vol % fine and ii) about 32 vol % of Carpenter Powder Product's 321 stainless steel binder powder.

Thus, about 54 grams of Sintec-Keramik's $TiB_2$ mixture having both coarse and fine grits at the ratio of 60 vol % coarse and 40 vol % fine were mixed with about 46 grams of 321 stainless steel binder in a ball mill in the presence of heptane for a time sufficient to substantially disperse the powders in each other. The mixture of powders was milled in a ball mill for about 4 hours with yttria toughened zirconia balls (10 mm diameter, from Tosoh Ceramics) at about 300 rpm. The heptane was removed from the mixed powders by a rotary evaporation method. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held for 30 min for residual solvent removal. The disc was then heated to 1500° C. at 15° C./min in argon and held at 1500° C. for 3 hours. The temperature was then reduced to below 100° C. at −15° C./min.

The resultant bimodal boride cermet comprised:

i) 67 vol % $TiB_2$ with a bimodal grit distribution of both coarse and fine grits ii) 4 vol % secondary boride $M_2B$ where M=50Cr:47Fe:3Ti in wt % iii) 29 vol % Cr-depleted alloy binder (73Fe:10Ni:14Cr:3Ti in wt %).

Illustrative Example 3

Bimodal $TiB_2$ Cermet Composition with ESK-Ceradyne's $TiB_2$ Grit and Stainless Steel Metal Binder Table 6 depicts exemplary coarse and fine $TiB_2$ grits and a metal binder used for producing bimodal boride cermets having a high packing density.

TABLE 6

| Company | Grade | Chemistry (wt %) | Size |
|---|---|---|---|
| ESK-Ceradyne | 411M20 (Fine) | Ti: Balance, B: 29.3%, C: 0.73%, O: 0.87%, N: 0.17%, Fe: 0.10% | $D_{s3}$ = 44.4 μm<br>$D_{s50}$ = 17.4 μm<br>$D_{s94}$ = 3.5 μm |
| ESK-Ceradyne | 408M3 (Coarse) | Ti: Balance, B: 29.5%, C: 1.11%, O: 0.61%, N: 0.18%, Fe: 0.16% | 99.9% −1000 μm |
| Carpenter Powder Products | 321SS | Balance<br>Fe: 18.0Cr: 10.0Ni: 1.2Ti: 1.4Mn: 0.2Si | 85% −31 μm |

Table 7 depicts the particle size distribution of ESK-Ceradyne's coarse $TiB_2$ grit (Grade 408M3) used for producing closely packed $TiB_2$ cermet in this invention. Fine grits screened below 200 mesh (75 μm) were discarded.

TABLE 7

| $TiB_2$ Mesh Size | Approximate Micron Size (μm) | Volume Fraction (%) |
|---|---|---|
| +45 | +355 | 25.9 |
| +60/−45 | +250/−355 | 17.1 |
| +140/−60 | +106/−250 | 31.0 |
| +200/−140 | +75/−106 | 16.0 |
| Total | | 100 |

Tap density and free volume have measured for various $TiB_2$ grit mixtures to determine the proper ratio of coarse and fine $TiB_2$ grits for bimodal boride cermets. The coarse grits used were particles screened above 200 mesh (75 μm) from the original grade 408M3. The fine grits used were as-supplied grade 411M20. Table 8 depicts the results of tap density measurement through the use of ESK-Ceradyne's $TiB_2$ grits.

TABLE 8

| Volume % of $TiB_2$ Grits, Coarse:Fine | Tap Density (g/cc) | Free Volume (%) |
|---|---|---|
| 50:50 | 3.10 | 32.3 |
| 55:45 | 3.15 | 31.7 |
| 60:40 | 3.20 | 31.3 |
| 65:35 | 3.15 | 31.7 |

As a non-limiting example, a bimodal boride cermet having a high packing density, is based on following formulation:

i) about 68 vol % of ESK-Ceradyne's $TiB_2$ mixture having both coarse and fine grits at the ratio of 60 vol % coarse and 40 vol % fine and ii) about 32 vol % of Carpenter Powder Product's 321 stainless steel binder powder.

Thus, about 54 grams of ESK-Ceradyne's $TiB_2$ mixture having both coarse and fine grits at the ratio of 60 vol % coarse and 40 vol % fine were mixed with about 46 grams of 321 stainless steel binder in a ball mill in the presence of heptane for a time sufficient to substantially disperse the powders in each other. The mixture of powders was milled in a ball mill for about 4 hours with yttria toughened zirconia balls (10 mm diameter, from Tosoh Ceramics) at about 300 rpm. The heptane was removed from the mixed powders by a rotary evaporation method. The dried powder was compacted in a 40 mm diameter die in a hydraulic uniaxial press (SPEX 3630 Automated X-press) at 5,000 psi. The resulting green disc pellet was ramped up to 400° C. at 25° C./min in argon and held for 30 min for residual solvent removal. The disc was then heated to 1500° C. at 15° C./min in argon and held at 1500° C. for 3 hours. The temperature was then reduced to below 100° C. at −15° C./min.

The resultant bimodal boride cermet comprised:

i) 68 vol % $TiB_2$ with a bimodal grit distribution of both coarse and fine grits ii) 4 vol % secondary boride $M_2B$ where M=50Cr:47Fe:3Ti in wt % iii) 28 vol % Cr-depleted alloy binder (73Fe:10Ni:14Cr:3Ti in wt %).

What is claimed is:

1. A bimodal cermet composition comprising: a) a ceramic phase, and b) a metal binder phase, wherein said ceramic phase is a metal boride with a bimodal distribution of non-spherical shaped particles, wherein at least one metal is selected from the group consisting of Group IV, Group V, Group VI elements of the Long Form of The Periodic Table of Elements and mixtures thereof, wherein said metal binder phase comprises at least one first clement selected from the group consisting of Fe, Ni, Co, Mn and mixtures thereof, and at least one second element selected from the group consisting of Cr, Al, Si and Y, and Ti, wherein said metal binder phase comprises about 5 to 40 vol. % of the volume of said bimodal cermet composition, wherein said bimodal distribution of non-spherical shaped particles comprises fine grit particles in the size range of about 3 to 60 microns and coarse grit particles in the size range of about 106 to 800 microns, wherein said coarse grit particles comprise at least 50 vol. % of the ceramic phase, and wherein the normalized erosion resistance HEAT index of the bimodal cermet composition ranges from 7 to 11.

2. The bimodal cermet composition of claim 1 wherein said at least one second element of said metal binder phase is from about 0.1 to about 3.0 wt % of the weight of said metal binder phase.

3. The bimodal cermet composition of claim 1 wherein said at least one second element is Cr at a loading of at least 12 wt % of the weight of said metal binder phase.

4. The bimodal cermet composition of claim 1 wherein said metal binder phase is a stainless steel composition including from about 0.1 to about 3.0 wt % Ti.

5. The bimodal cermet composition of claim 1 wherein said ceramic phase is from about 60 to about 95 vol % of the volume of said bimodal cermet composition.

6. The bimodal cermet composition of claim 5 wherein said ceramic phase is from about 60 to about 80 vol % of the volume of said bimodal cermet composition.

7. The bimodal cermet composition of claim 1 wherein said bimodal distribution of non-spherical shaped particles comprises fine grit particles with an average particle size of about 15 microns and coarse grit particles wit an average particle size of about 200 microns.

8. The bimodal cermet composition of claim 7 wherein said bimodal distribution of non-spherical shaped particles comprises about 50 vol % of said fine grit particles and about 50 vol % of said coarse grit particles.

9. The bimodal cermet composition of claim 1 wherein said bimodal distribution of non-spherical shaped particles comprises fine grit particles with an average particle size of about 10 microns and coarse grit particles with an average particle size of about 400 microns.

10. The bimodal cermet composition of claim 9 wherein said bimodal distribution of non-spherical shaped particles comprises about 40 vol % of said tine grit particles and about 60 vol % of said coarse grit particles.

11. The bimodal cermet composition of claim 1 further comprising at least one secondary metal boride, $M_xB_y$, wherein the molar ratio of x:y varies in the range of about 3:1 to about 1:6.

12. The bimodal cermet composition of claim 11 wherein M of said at least one secondary metal boride, $M_xB_y$, is selected from the group consisting of Group IV, Group V, Group VI elements of the Long Form of The Periodic Table of Elements, Fe, Ni, Co, Mn, Cr, Al, Y Si, and mixtures thereof.

13. The bimodal cermet composition of claim 1 further comprising an impurity phase selected from the group consisting of metal oxide, metal carbide, metal nitride, metal carbonitride phases and combinations thereof, wherein said metal is selected from the group consisting of Fe, Ni, Co, Mn, Al, Cr, Y, Si, Ti, Zr, Hf, V, Nb, Ta, Mo and W and mixtures thereof.

14. The bimodal cermet composition of claim 13 wherein said impurity phase constitutes less than about 5 vol % of the volume of said bimodal cermet composition.

15. The bimodal cermet composition of claim 14 wherein said impurity phase constitutes less than about 2 vol % of the volume of said bimodal cermet composition.

16. The bimodal cermet composition of claim 1 having a porosity up to about 15 vol % of the volume of said bimodal cermet composition.

17. A bimodal cermet composition comprising:

a) a $TiB_2$ phase with a bimodal distribution of non-spherical shaped particles;

b) a $M_2B$ phase wherein M is selected from the group consisting of Cr, Fe, Ni, Ti and combinations thereof;

c) an impurity phase selected from the group consisting of $TiO_2$, TiC, TiN, Ti(C,N), and combinations thereof; and d) a metal binder phase comprising at least one first element selected from the group consisting of Fe, Ni, Co, Mn and mixtures thereof and at least one second element selected from the group consisting of Cr, Al, Si and Y, and Ti, wherein said metal binder phase comprises about 5 to 40 vol. % of the volume of said bimodal cermet composition, wherein said bimodal distribution of non-spherical shaped particles comprises fine grit particles in the size range of about 3 to 60 microns and coarse grit particles in the size range of about 106 to 800 microns, wherein said coarse grit particles comprise at least 50 vol. % of the of the $TiB_2$ phase, and wherein the normalized erosion resistance HEAT index of the bimodal cermet composition ranges from 7 to 11.

18. The bimodal cermet composition of claim 17 wherein said at least one second element is from about 0.1 to about 3.0 wt % of the weight of said metal binder phase.

19. The bimodal cermet composition of claim 17 wherein said $TiB_2$ phase is from about 60 to about 95 vol % of the volume of said bimodal cermet composition.

20. The bimodal cermet composition of claim 17 wherein said bimodal distribution of non-spherical shaped particles comprises about 50 vol % of fine grit particles and about 50 vol % of coarse grit particles.

21. The bimodal cermet composition of claim 17 wherein said bimodal distribution of non-spherical shaped particles comprises about 40 vol % of fine grit particles and about 60 vol % of coarse grit particles.

22. The bimodal cermet composition of claim 17 wherein said impurity phase constitutes less than about 5 vol % of the volume of said bimodal cermet composition.

23. A method for protecting a metal surface subject to erosion at temperatures up to 1000° C., the method comprising the step of providing a metal surface with a bimodal cermet composition, wherein said composition comprises: a) a ceramic phase, and b) a metal binder phase, wherein said ceramic phase is a metal boride with a bimodal distribution of non-spherical shaped particles, wherein at least one metal is selected from the group consisting of Group IV, Group V, Group VI elements of the Long Form of The Periodic Table of Elements and mixtures thereof, wherein said metal binder phase comprises at least one first element selected from the group consisting of Fe, Ni, Co, Mn and mixtures thereof, and at least one second element selected from the group consisting of Cr, Al, Si and Y, and Ti, wherein said metal binder phase comprises about 5 to 40 vol. % of the volume of said bimodal cermet composition, wherein said bimodal distribution of non-spherical shaped particles comprises fine grit particles in the size range of about 3 to 60 microns and coarse grit particles in the size range of about 106 to 800 microns, wherein said coarse grit particles comprise at least 50 vol. % of the of the ceramic phase, and wherein the normalized erosion resistance HEAT index of the bimodal cermet composition ranges from 7 to 11.

24. The method for protecting a metal surface of claim 23 wherein said at least one second element of said metal binder phase is from about 0.1 to about 3.0 wt % of the weight of said metal binder phase.

25. The method for protecting a metal surface of claim 23 wherein said ceramic phase is from about 60 to about 95 vol % of the volume of said multimodal cermet composition.

26. The method for protecting a metal surface of claim 23 further comprising at least one secondary metal boride, $M_xB_y$, wherein the molar ratio of x:y varies in the range of about 3:1 to about 1:6, and wherein M of said at least one secondary metal boride, $M_xB_y$, is selected from the group consisting of Group IV, Group V, Group VI elements of the Long Form of The Periodic Table of Elements, Fe, Ni, Co, Mn, Cr, Al, Y Si, and mixtures thereof.

27. The method for protecting a metal surface of claim 23 further comprising an impurity phase selected from the group consisting of metal oxide, metal carbide, metal nitride, metal carbonitride phases and combinations thereof, wherein said metal is selected from the group consisting of Fe, Ni, Co, Mn, Al, Cr, Y, Si, Ti, Zr, Hf, V, Nb, Ta, Mo and W and mixtures thereof, and wherein said impurity phase constitutes less than about 5 vol % of the volume of said multimodal cermet composition.

28. The method for protecting a metal surface of claim 23 wherein the step of providing a metal surface with a bimodal cermet composition comprises the following steps:

a) mixing said ceramic phase and said metal binder phase in the presence of an organic liquid and a paraffin wax to form a flowable powder mix, b) placing said flowable powder mix into a die set, c) uniaxially pressing said die set containing said flowable powder mix at a pressure from about 40 to about 80 tons to form uniaxially pressed green bodies, d) heating said uniaxially pressed green bodies through a time-temperature profile to effectuate bum out of said paraffin wax and liquid phase sintering of said uniaxially pressed green bodies to form a sintered bimodal boride cermet composition, and e) cooling said sintered bimodal boride cermet composition at a cooling rate of about 5° C./minute to form a bimodal boride cermet composition tile.

29. The method for protecting a metal surface of claim 28 further comprising the step of cold isostatic pressing said uniaxially pressed green bodies of step d) at a pressure of about 30,000 psi to form uniaxially and cold isostatic pressed green bodies for further processing.

30. The method for protecting a metal surface of claim 28 wherein said mixing step is selected from the group consisting of ball milling, V-blending, spray drying, pucking and screening, Littleford mixing, Patterson-Kelley mixing, jar rolling and disc pelletizing.

31. The method for protecting a metal surface of claim 30 wherein said mixing step is ball milling with a ball milling media comprising yttria stabilized zirconia.

32. The method for protecting a metal surface of claim 31 wherein said yttria stabilized zirconia constitutes less than 40 wt % of the combined weight of the ceramic phase and metal binder phase.

33. The method for protecting a metal surface of claim 28 wherein said mixing step is carried out for about 4 hours.

34. The method for protecting a metal surface of claim 28 wherein said paraffin wax constitutes about 2 to about 4 wt % of the combined weight of the ceramic phase and metal binder phase.

35. The method for protecting a metal surface of claim 28 wherein said heating step is carried out under vacuum, in an inert atmosphere, or in a reducing atmosphere.

36. The method for protecting a metal surface of claim 35 wherein said time-temperature profile of said heating step further comprises the following steps:

a) heating said uniaxially pressed green bodies to about 400° C. at a heating rate of about 3° C./minute and maintaining said about 400° C. for about 100 minutes, b) heating said uniaxially pressed green bodies from about 400° C. to about 600° C. at a heating rate of about 3° C./minute and maintaining said about 600° C. for about 90 minutes, and c) heating said uniaxially pressed green bodies from about 600° C. to a liquid phase sintering temperature of from about 1200° C. to about 1750° C. at a heating rate of about 5° C./minute and maintaining said liquid phase sintering temperature for about 180 minutes.

37. The method for protecting a metal surface of claim 28 further comprising the step of affixing said bimodal boride cermet composition tile to the inner metal surface of refinery and chemical process equipment.

38. The method for protecting a metal surface of claim 37, wherein said bimodal boride cermet composition comprises the inner surface of refinery and chemical process equipment selected from the group consisting of process vessels, transfer lines and process piping, heat exchangers, cyclones, grid inserts, thermo wells, valve bodies, slide valve gates and guides, and combinations thereof.

39. A method for protecting a metal surface subject to erosion at temperatures up to 1000° C. with a bimodal boride cermet composition, the method comprising the following steps:

a) providing a bimodal boride cermet composition, wherein said composition comprises:

i) a $TiB_2$ phase with a bimodal distribution of non-spherical shaped particles;

ii) a $M_2B$ phase wherein M is selected from the group consisting of Cr, Fe, Ni, Ti and combinations thereof;

iii) an impurity phase selected from the group consisting of $TiO_2$, TiC, TiN, Ti(C,N), and combinations thereat and iv) a metal binder phase comprising at least one first element selected from the group consisting of Fe, Ni, Co, Mn and mixtures thereof, and at least one second element selected from the group consisting of Cr, Al, Si and Y, and Ti, wherein said metal binder phase comprises about 5 to 40 vol. % of the volume of said bimodal cermet composition, wherein said bimodal distribution of non-spherical shaped particles comprises fine grit particles in the size range of about 3 to 60 microns and coarse grit particles in the size range of about 106 to 800 microns, wherein said coarse grit particles comprise at least 50 vol. % of the of the $TiB_2$ phase, and wherein the normalized erosion resistance HEAT index of the bimodal cermet composition ranges from 7 to 11, b) mixing said ceramic phase and said metal binder phase in the presence of an organic liquid and a paraffin wax to form a flowable powder mix, c) placing said flowable powder mix into a die set, d) uniaxially pressing said die set containing said flowable powder mix at a pressure from about 40 to about 80 tons to form uniaxially pressed green bodies, e) heating said uniaxially pressed green bodies through a time-temperature profile to effectuate burn out of said paraffin wax and liquid phase sintering of said uniaxially pressed green bodies to form a sintered bimodal boride cermet composition, f) cooling said sintered bimodal boride cermet composition at a cooling rate of about 5° C./minute to form a bimodal boride cermet composition tile, and g) affixing said bimodal boride cermet composition tile to said metal surface to be protected.

40. The method for protecting a metal surface of claim 39 further comprising the step of cold isostatic pressing said uniaxially pressed green bodies of step d) at a pressure of about 30,000 psi to form uniaxially and cold isostatic pressed green bodies for further processing.

41. The method for protecting a metal surface of claim 39 wherein said paraffin wax constitutes about 2 to about 4 wt % of the combined weight of the ceramic phase and metal binder phase.

42. The method for protecting a metal surface of claim 39 wherein said heating step is carried out under vacuum, in an inert atmosphere, or in a reducing atmosphere.

43. The method for protecting a metal surface of claim 42 wherein said time-temperature profile of said heating step further comprises the following steps:

a) heating said uniaxially pressed green bodies to about 400° C. at a heating rate of about 3° C./minute and maintaining said about 400° C. for about 100 minutes, b) heating said uniaxially pressed green bodies from about 400° C. to about 600° C. at a heating rate of about 3° C./minute and maintaining said about 600° C. tier about 90 minutes, and c) heating said uniaxially pressed green bodies from about 600° C. to a liquid phase sintering temperature of from about 1200° C. to about 1750° C. at a heating rate of about 5° C./minute and maintaining said liquid phase sintering temperature for about 180 minutes.

44. The method for protecting a metal surface of claim 43 wherein said bimodal boride cermet composition comprises the inner surface of refinery and chemical process equipment.

45. The method for protecting a metal surface of claim 43 wherein said second element is from about 0.1 to about 3.0 wt % of the weight of said metal binder phase.

* * * * *